US009079050B2

(12) United States Patent
Bedetti et al.

(10) Patent No.: US 9,079,050 B2
(45) Date of Patent: Jul. 14, 2015

(54) STRUCTURAL FIRE GLOVE

(71) Applicant: Ansell Limited, Richmond, Victoria (AU)

(72) Inventors: Pablo Ignacio Bedetti, Red Bank, NJ (US); Lee Khommanyvong, Rockwell City, IA (US); Louis Orotelli, Colonia, NJ (US)

(73) Assignee: Ansell Limited, Victoria (AU)

( * ) Notice: Subject to any disclaimer, the term of this patent is extended or adjusted under 35 U.S.C. 154(b) by 151 days.

(21) Appl. No.: 13/715,224

(22) Filed: Dec. 14, 2012

(65) Prior Publication Data

US 2013/0152262 A1 Jun. 20, 2013

Related U.S. Application Data

(60) Provisional application No. 61/576,708, filed on Dec. 16, 2011.

(51) Int. Cl.

| | |
|---|---|
| ***A41D 19/00*** | (2006.01) |
| ***A62B 17/00*** | (2006.01) |
| ***A41D 13/08*** | (2006.01) |
| ***A41D 19/015*** | (2006.01) |

(52) U.S. Cl.

CPC ..... *A62B 17/003* (2013.01); *A41D 13/081* (2013.01); *A41D 19/01529* (2013.01)

(58) Field of Classification Search

CPC ..... A41D 13/081; A41D 19/01529; A62B 17/003

USPC ..... 2/16, 247, 248, 158, 159, 160, 161.5, 2/161.6, 162, 166, 167, 170

See application file for complete search history.

(56) References Cited

U.S. PATENT DOCUMENTS

| | | | | | |
|---|---|---|---|---|---|
| 204,199 | A | * | 5/1878 | Chow | 2/248 |
| 1,010,199 | A | * | 11/1911 | Stedman | 2/162 |
| 1,250,150 | A | * | 12/1917 | Du Bois | 2/158 |
| 1,424,639 | A | * | 8/1922 | Guerin | 2/160 |
| 4,471,495 | A | * | 9/1984 | Kruse et al. | 2/162 |
| 4,809,365 | A | | 3/1989 | Chen et al. | |
| 4,876,747 | A | | 10/1989 | Coffey et al. | |
| 5,579,539 | A | | 12/1996 | Flick | |
| 5,598,582 | A | | 2/1997 | Andrews et al. | |
| 6,061,833 | A | * | 5/2000 | Smith et al. | 2/162 |
| 7,007,308 | B1 | | 3/2006 | Howland et al. | |
| 7,275,267 | B2 | | 10/2007 | Thiruppathi | |
| 7,434,422 | B2 | * | 10/2008 | Thompson et al. | 66/174 |
| 7,478,440 | B2 | | 1/2009 | Dolenak | |

(Continued)

FOREIGN PATENT DOCUMENTS

| | | |
|---|---|---|
| CN | 2515984 Y | 10/2002 |
| DE | 20301959 U1 | 6/2003 |

(Continued)

OTHER PUBLICATIONS

PCT Search report and written opinion, PCT/US2012/069743, 7 pages, Date of mailing Apr. 18, 2013.

(Continued)

*Primary Examiner* — Anna Kinsaul

(74) *Attorney, Agent, or Firm* — Moser Taboada

(57) ABSTRACT

A highly flexible, flame-resistant, multi-layer glove, including a knitted, flame-resistant inner liner, a moisture barrier layer, a heat-activated glove-shaped web-adhesive disposed between the inner liner and moisture barrier layer, and a flame-resistant shell disposed over the moisture barrier layer, and methods for manufacturing, are disclosed.

28 Claims, 6 Drawing Sheets

(56) References Cited

U.S. PATENT DOCUMENTS

| | | | | |
|---|---|---|---|---|
| 7,665,155 | B2 * | 2/2010 | Grilliot et al. | 2/252 |
| 7,761,931 | B2 | 7/2010 | Schrodl | |
| 7,937,773 | B1 | 5/2011 | Kleinert | |
| 2007/0061942 | A1 * | 3/2007 | Schrodl | 2/159 |
| 2007/0083979 | A1 * | 4/2007 | Daniels | 2/160 |
| 2008/0201823 | A1 | 8/2008 | Jaeger | |
| 2009/0183296 | A1 * | 7/2009 | Hardee et al. | 2/161.8 |
| 2010/0071114 | A1 | 3/2010 | Jaeger | |
| 2010/0275341 | A1 * | 11/2010 | Sweeney et al. | 2/164 |

FOREIGN PATENT DOCUMENTS

| | | | |
|---|---|---|---|
| EP | 0724848 | A1 | 8/1996 |
| EP | 0874668 | B1 | 4/1998 |
| EP | 0724848 | B1 | 9/1998 |
| JP | 8158122 | A | 6/1996 |
| RU | 2295269 | C1 | 3/2007 |
| RU | 92769 | U1 | 4/2010 |
| RU | 2010120705 | A | 11/2011 |
| RU | 2454907 | C2 | 7/2012 |
| SU | 1369661 | A3 | 1/1988 |
| WO | WO-2010037773 | A1 | 4/2010 |

OTHER PUBLICATIONS

PCT International Preliminary Report on Patentability, PCT/US2012/069743, 5 pages, Date of issuance Jun. 17, 2014.

* cited by examiner

STRUCTURAL FIRE GLOVE

CROSS REFERENCE TO RELATED APPLICATIONS

This application claims priority under 35 U.S.C. 119(e) to U.S. Provisional Application Ser. No. 61/576,708 filed Dec. 16, 2011, which is hereby incorporated by reference in its entirety.

FIELD

The present application relates generally to protective gloves and, more particularly, embodiments of the invention relate to gloves providing protection from extreme heat and fire and methods of making protective gloves.

BACKGROUND

A firefighter's hands are the most important tool in fighting fire and rescuing people from fire emergencies. Firefighting presents many different types of hazards against which firefighters must be protected. For example, a firefighter will encounter extreme heat, direct contact with fire and flash-flames, blood-borne pathogens, chemicals, water, steam, and the like. Furthermore, gloves used by firefighters need to protect from injury from puncture and cuts. Therefore, adequate protection of the hands is paramount and, accordingly, a firefighter's glove must offer resistance against these hazards. Thick, heavy-duty gloves are the standard for firefighting, which are very bulky, including inflexible shells and insulation, and are formed from cut-and-sewn manufacturing processes.

However, converse to these heavy-duty strength requirements, gloves for firefighters must now also offer flexibility, tactility for fingers and thumb (for instance, because of the need to operate small, electronic controls, gas sensors, flashlights, dead-bolt locks, knobs, and the like, some having dimensions as small as ⅜ inch). The glove of a firefighter must also permit high dexterity, including finger dexterity and palm dexterity, and excellent grip properties for grasping and controlling objects with strength, such as, but not limited to, hoselines and nozzles, ladder rungs, halligan tools, personal escape ropes, and the like in order for firefighters to perform duties quickly, safely, and adequately while exerting a high amount of force onto heavy or light objects while wearing the glove.

In addition, firefighters must be able to don and doff gloves easily and quickly, particularly while moist. Moreover, the gloves must maintain softness and pliability after withstanding many usage cycles, i.e., hot-cold, wet-dry. In addition to these in-use functional requirements, an aesthetically pleasing glove that is easily cleaned, and can be laundered and decontaminated repeatedly, without loss of softness and pliability is needed. In sum, gloves must protect the hands of firefighters against multiple and varied hazards without compromising movement and dexterity.

To date, there is no flame-resistant, protective, heavy-duty firefighter's glove that also offers high dexterity and flexibility, while remaining easy to don and doff while wet. It would therefore be a significant advance in the art to provide a glove addressing these previously unmet needs.

SUMMARY

A highly flexible, flame-resistant, multi-layer glove, which includes a seamless, knitted, flame-resistant inner liner, a moisture barrier layer, a heat-activated glove-shaped web-adhesive disposed between the inner liner and moisture barrier layer, and a flame-resistant shell disposed over the moisture barrier layer is disclosed.

DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only illustrative embodiments of this invention and are therefore not to be considered limiting of its scope, for the invention may admit to other equally effective embodiments.

Figure 1:
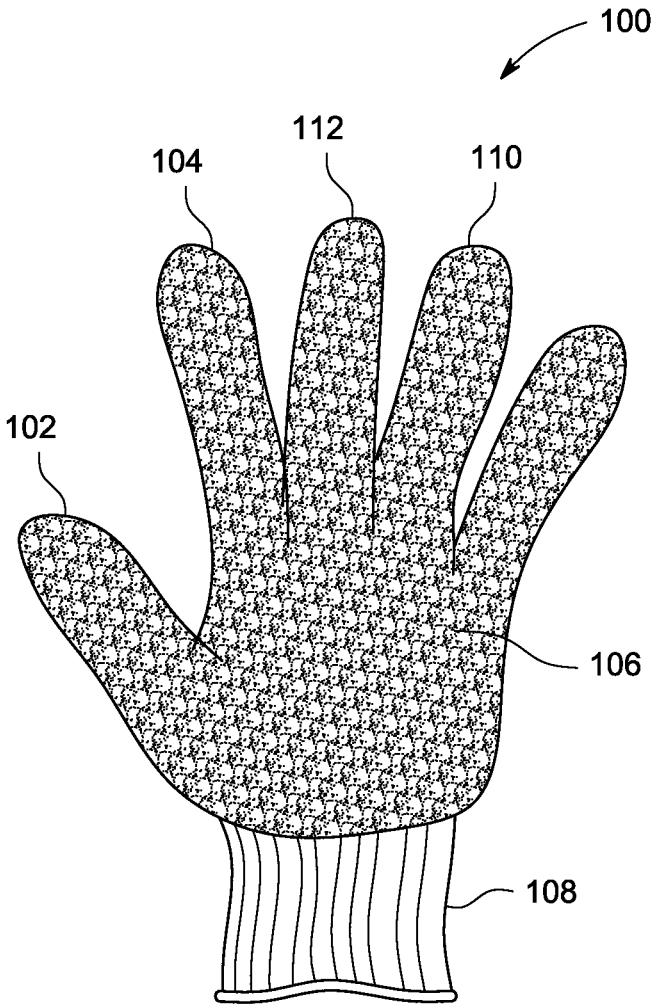
FIG. 1 depicts a plan view of a seamless knitted inner liner in accordance with embodiments of the invention.

To facilitate understanding, identical reference numerals have been used, where possible, to designate comparable elements which are common to the figures. The figures are not drawn to scale and may be simplified for clarity. It is contemplated that elements and features of one embodiment may be beneficially incorporated in other embodiments without further recitation.

DETAILED DESCRIPTION

Gloves in accordance with embodiments of the invention maximize "gloves-on" tasks, i.e., gloves that can be worn while performing many different tasks, from the control of small buttons on electronic devices to tasks requiring strength and grip, such as handling rope, climbing ladder rungs, use of tools, such as hoses and halligans, as well as the requisite protection from heat and fire and flash-steam within gloves because of the application of pressure to a wet, heated glove. Because of the structure and properties of the glove, firefighters can wear the gloves during essentially all situations they encounter, resulting in much safer conditions.

A fire resistant glove according to embodiments of the invention is depicted in FIGS. 1-4. FIG. 1 depicts a plan view of a seamless knitted inner liner in accordance with embodiments of the invention. The liner 100 comprises thumb 102, fingers 104, palm area 106, backhand area (not shown), and cuff 108. Liner 100 further comprises yarn 110 and yarn channels 112. Liner 100 may be knitted into the form of a glove by any conventional knitting process, typically using 7-, 10-, 13-, 15-, or 18-gauge needles, and may comprise various deniers of yarns or any suitable yarn. In some embodiments, liner 100 comprises a heat- and flame-resistant material, such as, KEVLAR® para-aramid, NOMEX® meta-aramid, modacrylic, flame-resistant treated cotton, or combinations of any or all. Alternately, liner 100 may comprise a composite yarn having a fiberglass and/or steel wire core as is disclosed in commonly-assigned Patent Publ. No. 2009/0183296, which is herein incorporated by reference in its entirety.

In some embodiments, as yarn 110 is knitted, channels 112 form between the courses of the knit. If these channels run in a direction parallel, as is shown in FIG. 1, to a longitudinal axis of liner 100, the inside surface of the glove presents these channel patterns as running in a lateral direction. If the glove is inverted, or turned inside out, the opposite is therefore true. Arranging a glove in this manner can be an advantage because the glove is easier to don when the channels run longitudinally, providing less friction against a hand entering the glove and particularly a wet glove. In some embodiments, the liner 100 material may be a monofilament yarn, rather than a spun or composite yarn, which will retain less moisture and will also reduce the friction encountered when donning the glove. Furthermore, because there is also less friction when removing a hand from the glove, the liner will not pull out of the shell, which will be difficult to put back into the shell and certainly cannot be accomplished quickly. It is also possible to knit the liner so that the courses run in a longitudinal direction without inverting the liner. In some embodiments, the liner may have a terry-looped outer surface of the same or different yarn material, as a means of increasing the thermal insulative properties of the liner. In some embodiments, the glove may be a liner knitted according to the knitted variable stitch dimension technology (KVSD) disclosed in commonly assigned U.S. Pat. No. 7,434,422, which is herein incorporated by reference in its entirety. The incorporation of the KVSD technology allows areas of selectively increased stitch density, providing additional protection in areas of the hand more prone to injury, such as the knuckles, without increasing the overall bulkiness of the glove or detracting from its flexibility. The liner may also comprise the seamless knit technology according to the co-pending, commonly assigned U.S. Patent Publ. No. 2010/0275341, which is herein incorporated by reference in its entirety.

Figure 2:
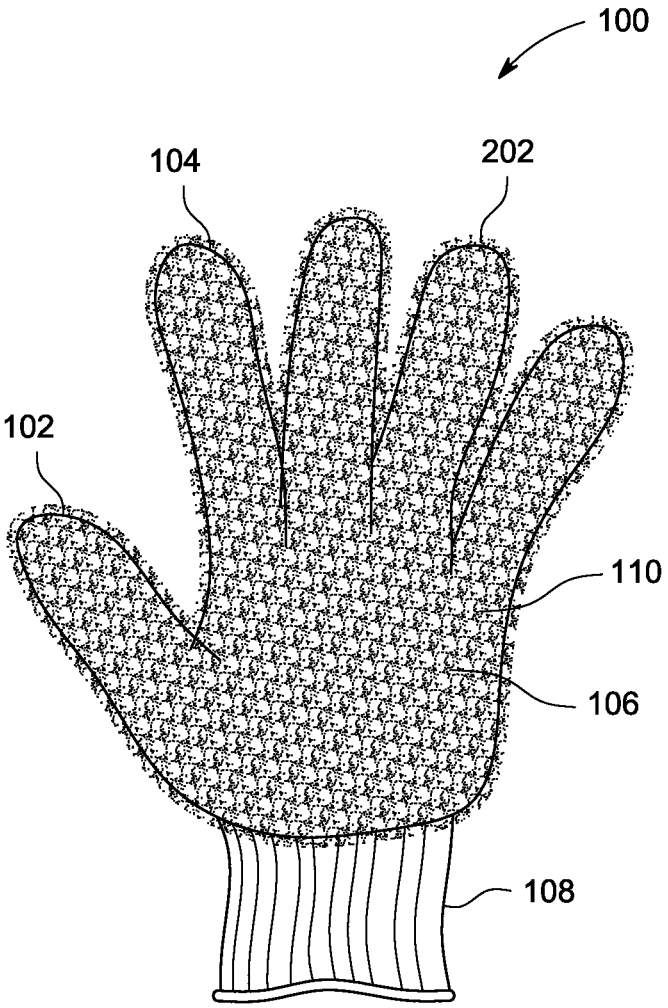
FIG. 2 depicts a plan view of a seamless knitted inner liner having a terry-knit outer surface in accordance with embodiments of the invention.

FIG. 2 depicts a plan view of a knitted liner having a terry looped surface in accordance with embodiments of the invention. The terry loop-like surface 202 can be made, for example, by knitting an extra outward facing loop. A terry looped surface creates extra pockets of air thereby increasing the insulative effect. The terry looped surface 202 may be created on any one or all, or any combination of thumb 102, fingers 104, palm area 106, or the backhand/knuckle area. As will be discussed below, the terry looped outer surface 202 can provide flexibility, and insulation in lieu of an additional insulation layer, which would otherwise need to be provided and attached. One fewer layer allows the glove to be commensurately less bulky and more flexible.

Figure 3C:
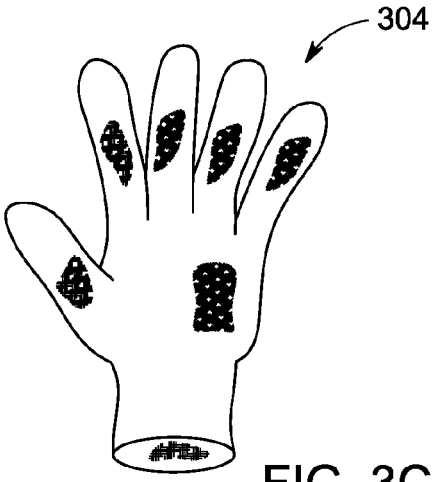
FIGS. 3A-3F depict an exploded view of the glove in accordance with embodiments of the invention.
Figure 3B:
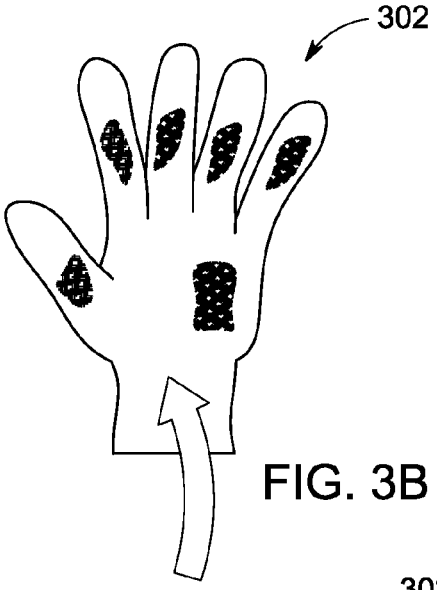
Figure 3A:
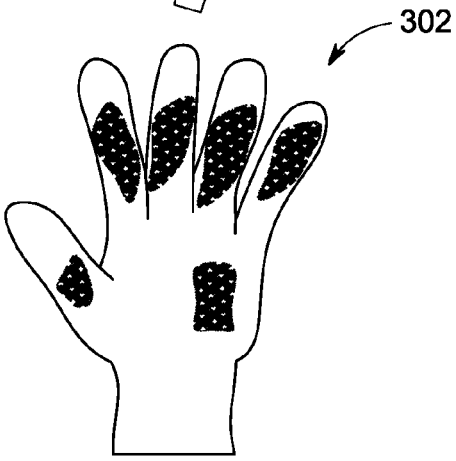
Figure 3F:
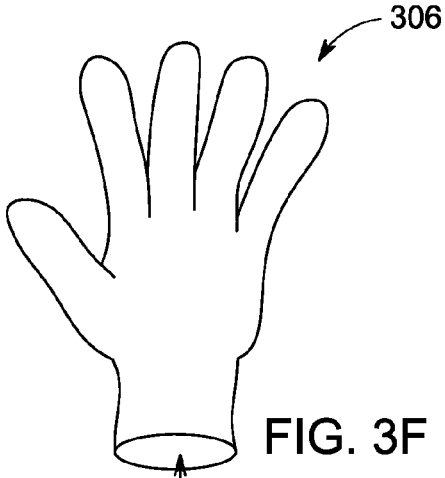
Figure 3E:
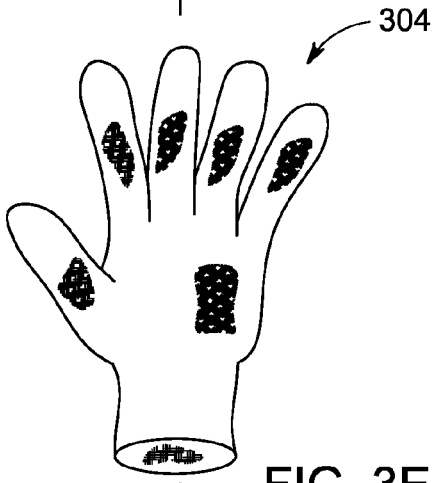
Figure 3D:
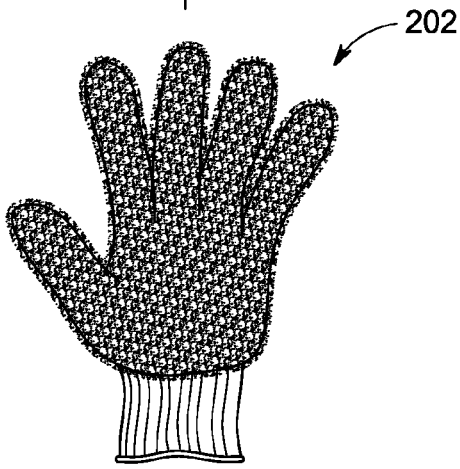

FIGS. 3A-3F depict an exploded view of the glove in accordance with embodiments of the invention. FIG. 3A is a web-adhesive layer cut from a sheet into the shape and slightly-larger size of terry looped liner 202 in FIG. 3D. The web-adhesive may comprise a polyamide or other polymeric adhesive. Furthermore, the web-adhesive may also be made flame-resistant for applications such as for a firefighter's glove. FIG. 3B is a similar glove-shaped web-adhesive layer. The web-adhesives 302 are non-tacky adhesives that are heat-activated. The two separate web-adhesive layers may be joined and heat-staked to create the glove-shaped web-adhesive 304 as shown in FIG. 3C. The fleeced knit liner 202 in FIG. 3D is then placed within web-adhesive 304 as shown in FIG. 3E. The construction of the terry looped liner 202 and web-adhesive 304 may then be placed inside a glove-shaped moisture barrier layer 306. The moisture barrier layer may comprise a polyurethane membrane such as Porelle® brand membrane or a expanded polytetrafluoroethylene (ePTFE) membrane such as a GoreTex® brand membrane. The moisture barrier layer 306 is permanently bonded to terry looped liner 202 by heating with heating irons, heated steel dies, convective heated air, or the like. The application of heat and/or pressure allows all areas of the seamless, knitted liner to be permanently affixed to the moisture barrier layer without compromising the breathability of the moisture barrier layer. The three-layer construction of the seamless, knitted liner, web-adhesive layer, and moisture-barrier layer may subsequently be inserted into another web-adhesive 304, and inserted into an outer shell. The shell may be made of any suitable flame-resistant and/or cut-resistant material or materials. For example, the shell may comprise flame-resistant treated cowhide leather, KEVLAR® para-aramid, NOMEX® meta-aramid, oxidized polyacrylonitrile fibers (OPD) CarbonX®, and/or the like. Also, optionally, an additional insulation layer may be disposed between the moisture barrier layer and the shell.

Figure 4:
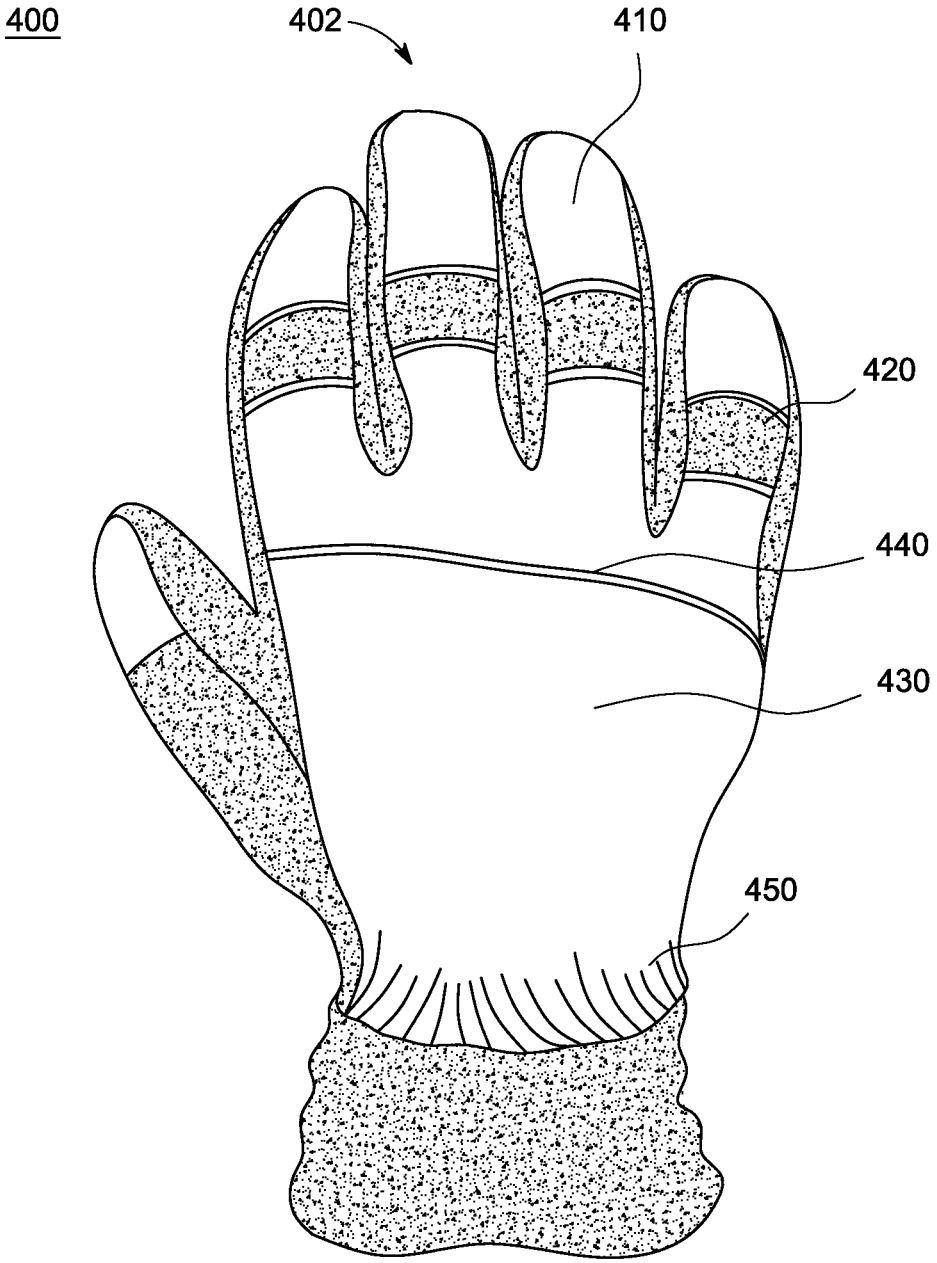
FIG. 4 depicts a plan view of a glove in accordance with embodiments of the invention.

FIG. 4 depicts a plan view of a glove in accordance with embodiments of the invention. Glove 400 comprises shell 402 having fingers 410, backhand area 430, and, optionally, a crimped cuff 450. As discussed above, a flame-resistant glove that allowing flexibility, tactility, and dexterity is important to firefighters. These properties can be achieved, at least in part, with the following features. Shell 402 optionally comprises pleats 420, 440 on fingers 410 and backhand area 430 respectively. Shell 402 is also optionally preformed into a bent configuration. In other words, the glove is formed as if there is a hand within it that is partially bent at the knuckles, i.e., a partially clenched fist. Such a glove requires less travel to clench to a closed fist. The bent glove feature and the pleats lessen the amount of compression on the glove during use, rendering it more flexible and dexterous, as well as allowing a better fit and feel to the glove. Importantly, because there is less compression during clenching, when water is in or on the glove, the wearer will feel less heat because the glove will not be as tight to the skin. In other words, the gloves are expected to get wet during service, from both sweat and water used to extinguish fires, and, of course, firefighters will be exposed to high-temperature radiant heat and/or flames. Nonetheless, the amount of heat that the wearer feels can be substantially lessened. In previous gloves, when the hand is clenched to a fist, all parts of the glove become significantly compressed. During use, hot water within a tight glove allows the water to flash, becoming steam capable of injuring the wearer. The hot water, combined with the pressure created by compression forces, allows the water to become steam. Because embodiments of the present invention lessen the amount of pressure within the glove during use, this condition is less likely to occur and will be less severe. The material on the back of the hand is patterned in a way to afford sufficient material to cover the fully curved hand without excess compression on the knuckles. When the hand is straightened out, excess material creates a baggy fold across the main knuckles that does not interfere with firefighter hand function and serves to increase the insulative performance of the glove.

Figure 5:
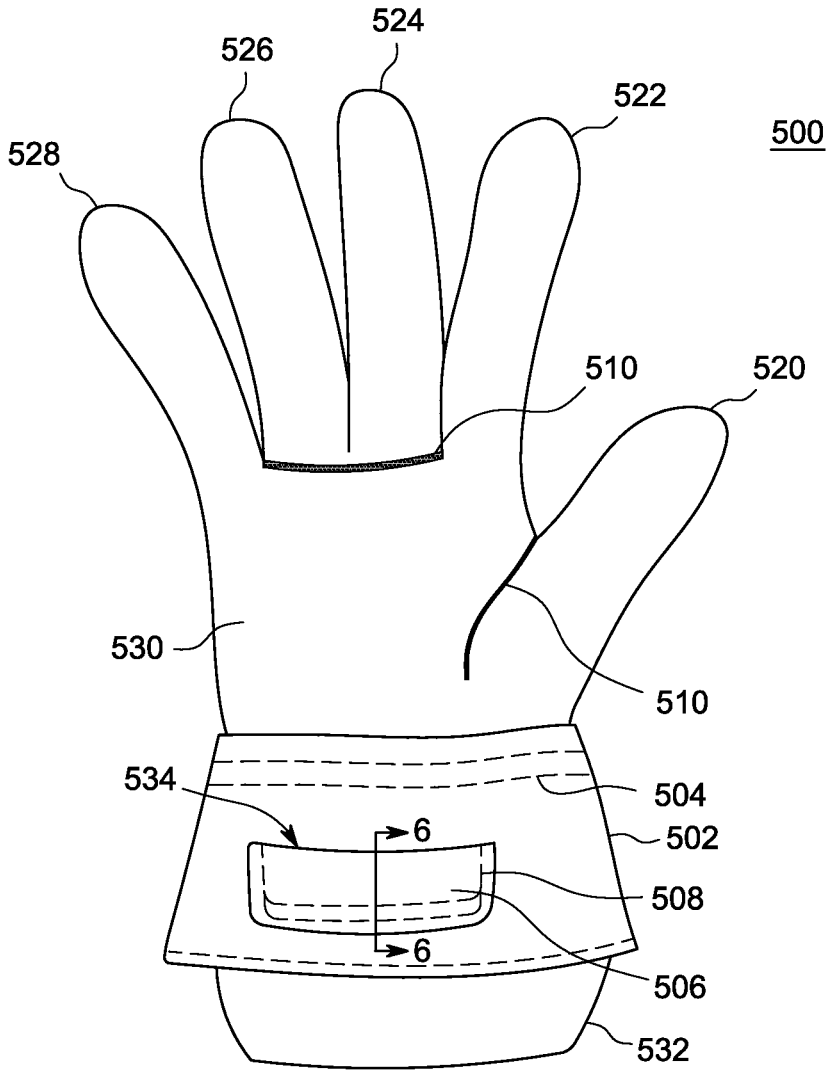
FIG. 5 depicts a plan view of the palm side of a glove having a cuff bar in accordance with embodiments of the invention.

FIG. 5 depicts a plan view of the palm side of a glove having a cuff bar in accordance with embodiments of the invention. Glove 500 may be a glove in accordance with other gloves or gloves in accordance with the present invention, such as glove 400. Glove 500 includes thumb 520 and fingers 522, 524, 526, and 528. Glove 500 further comprises reinforced seams 510. Reinforced seams 510, as shown along fingers 522, 524, 526, and 528 or, alternatively, between the crotch made by finger 522 and thumb 520, are sewn into the shell 530 and add stability and strength to glove 500. Glove 500 also comprises cuff 502, which is sewn with stitches 504 onto shell 530 around its entire periphery. As shown, stitches 504 is a double stitch. Stitches 504 may comprise 1 stitch or several stitches as necessary for a given application. Also, glove 500 comprises lower cuff 532. Lower cuff 532 may be an integral part of the liner, as discussed with respect to glove 400, i.e., knitted with the rest of the liner or, optionally, may be attached later. FIG. 5 depicts the cuff 502 having an outer surface, a lower edge and an upper edge. The cuff bar 506 is shown having a top portion and being affixed to the outer surface of the cuff 502 at the middle portion, the bottom portion, the first side portion and the second side portion. The middle portion is affixed between the top portion and the bottom portion. FIG. 5 further depicts the top portion of the cuff grab bar adjacent to the upper edge of the cuff and the bottom portion of the cuff grab bar adjacent to the lower edge of the cuff. In some embodiments of the invention, lower cuff 532 comprises a different material than the liner, such as fire-retardant yarns. In some embodiments of the invention, in addition to fire-retardant properties, a blend of yarns may be used to impart other properties, such as cut- and or chemical-resistance.

Gloves 400 and 500 also comprise cuff bar 506, which is sewn onto cuff 502 with stitch 508. Cuff bar 506 is used to don the glove. For example, gloves in fire service often become wet, making them more difficult to put on. Cuff bar 506 may be used as a holder to grip and pull on a glove, even if the wearer is already wearing a glove on the opposite hand. Additionally, because cuff bar 506 is closed off, it presents less of a snag hazard than other constructions, such as a loop mechanism. Cuff bar 506 comprises heat- and flame-resistant material, such as, flame-resistant treated cowhide leather (for e.g., brominated and/or chlorinated fire retardants), oxidized polyacrylonitrile fibers (OPD) CarbonX®, KEVLAR® para-aramid, NOMEX® meta-aramid, modacrylic, flame-resistant treated cotton, or combinations of any or all. Alternately, cuff bar 506 may comprise a composite yarn having a fiberglass and/or steel wire core as is disclosed in commonly-assigned Patent Publ. No. 2009/0183296, as discussed above.

Figure 6:
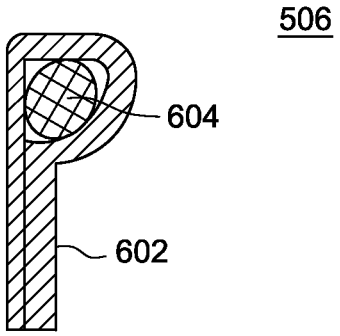
FIG. 6 depicts a cross-section view of the cuff bar of FIG. 5 in accordance with embodiments of the invention.

FIG. 6 depicts a cross-section view of a cuff bar in accordance with embodiments of the invention. Cuff bar 506 comprises a fire- and/or flame-resistant strip of leather 602. Strip leather 602 encases a fire- and/or flame-resistant member 604. The fire- and/or flame-resistant member 604 is placed within strip leather 602 and sewn to cuff 502 with stitches 508, as discussed above, creating a pouch or pocket 534 between cuff 502 and cuff bar 506.

Figure 7:
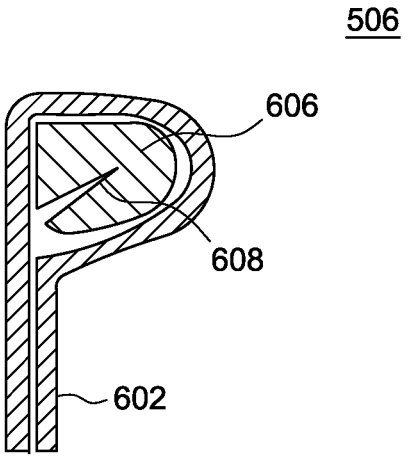
FIG. 7 depicts a cross section view of an alternate design of a cuff bar in accordance with embodiments of the invention.

FIG. 7 depicts a cross section view of an alternate design of a cuff bar in accordance with embodiments of the invention. In this embodiment, cuff bar 506 has fire- and/or flame-resistant member 606, which further comprises a resilient material, such as a memory foam. The resilient material is folded over at fold 608. Fire- and/or flame-resistant member 606 is placed so that the fold 608 biases cuff bar 506 closed or, in other words, pocket 534 is compressed. This represents an advance because in addition to helping don the glove, debris, such as airborne burning embers, cannot collect as would be possible with a loose, open-ended pocket. Moreover, water is less likely to collect there, alleviating the flash-steam within gloves during the application of pressure to a wet, heated glove, as discussed above. Other biasing members, such as bent metallic or polymeric leaf springs and the like are also potential designs with the scope of embodiments of the invention.

Although some embodiments have been discussed above, other implementations and applications are also within the scope of the following claims. Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the following claims.

Publications and references, including but not limited to patents and patent applications, cited in this specification are herein incorporated by reference in their entirety in the entire portion cited as if each individual publication or reference were specifically and individually indicated to be incorporated by reference herein as being fully set forth. Any patent application to which this application claims priority is also incorporated by reference herein in the manner described above for publications and references.

What is claimed is:

1. A glove comprising:

a cuff comprising an outer surface, a lower edge and an upper edge, the upper edge affixed to a shell of the glove around its periphery;

a resilient cuff grab bar having a top portion, a bottom portion, a first side portion, a second side portion, and a middle portion between the top portion and the bottom portion, wherein the resilient cuff grab bar comprises:

a resilient member; and a flexible strip of material which surrounds the resilient member;

wherein the resilient cuff grab bar is affixed to the outer surface of the cuff of the glove along the first side portion, the second side portion, the middle portion and the bottom portion to enclose the resilient member between the middle portion and the top portion and in combination with the cuff form a closed off pocket between the resilient cuff grab bar and the cuff, and wherein the top portion of the cuff grab bar is adjacent to the upper edge of the cuff and the bottom portion of the cuff grab bar is adjacent to the lower edge of the cuff.

2. The glove of claim 1, wherein the cuff comprises a flexible, fame-resistant material.

3. The glove of claim 1, wherein the resilient member which forms the resilient cuff grab bar comprises a yarn having a fiberglass wire core.

4. The glove of claim 1, wherein the resilient member which forms the resilient cuff grab bar comprises a yarn having a steel wire core.

5. The glove of claim 1, wherein the resilient member which forms the resilient cuff grab bar comprises a memory foam.

6. The glove of claim 2, wherein the resilient member which forms the resilient cuff grab bar comprises a memory foam.

7. The glove of claim 2, wherein the flexible strip of material comprises a strip of flexible, fame-resistant material.

8. The glove of claim 7, wherein the resilient member which forms the resilient cuff grab bar comprises a memory foam.

9. The glove of claim 5, wherein the memory foam biases the cuff grab bar closed.

10. The glove of claim 6, wherein the memory foam biases the cuff grab bar closed.

11. A flexible, seamless, flame-resistant, multi-layer glove, comprising:

a seamless, knitted, inner flame-resistant liner;

a moisture barrier layer, a flame-resistant shell disposed over the moisture barrier layer;

a cuff comprising an outer surface, a lower edge and an upper edge, the upper edge affixed to the shell of the glove around its periphery;

a resilient cuff grab bar having a top portion, a bottom portion, a first side portion, a second side portion, and a middle portion between the top portion and the bottom portion, wherein the resilient cuff grab bar comprises:

a resilient member; and a flexible strip of material which surrounds the resilient member;

wherein the resilient cuff grab bar is affixed to the outer surface of the cuff of the glove along the first side portion, the second side portion, the middle portion and the bottom portion to enclose the resilient member between the middle portion and the top portion and in combination with the cuff form a closed off pocket between the resilient cuff grab bar and the cuff, and wherein the top portion of the cuff grab bar is adjacent to the upper edge of the cuff and the bottom portion of the cuff grab bar is adjacent to the lower edge of the cuff.

12. The multi-layer glove of claim 11, wherein the liner comprises a cut-resistant yarn.

13. The multi-layer glove of claim 11, wherein the liner has a terry looped surface.

14. The multi-layer glove of claim 11, wherein the moisture barrier layer is chosen from a breathable expanded polytetrafluoroethylene membrane or a polyurethane membrane.

15. The multi-layer glove of claim 11, wherein the flame-resistant shell comprises a natural leather or textile.

16. The multi-layer glove of claim 11, wherein the liner comprises para-aramid, meta-aramid, modacrylic, flame-resistant treated cotton, a steel-fiberglass core composite yarn, or combinations thereof.

17. The multi-layer glove of claim 11, wherein the liner comprises a composite yarn, the composite yarn comprising a fiberglass core and a steel fiber, the core having a core sheath of microdenier staple cut resistant fibers of a para-aramid or staple modacrylic fibers, and polyester or para-aramid wraps.

18. The multi-layer glove of claim 11, wherein the glove further comprises an insulation layer.

19. The multi-layer glove of claim 11, wherein the glove is compliant and/or certified to NFPA 1971, NFPA 1951, NFPA 1999, NFPA 2012, or military requirements.

20. A method for forming a flexible, seamless, flame-resistant, multi-layer glove, comprising the steps of:

placing a first heat-activated, glove-shaped web-adhesive onto a seamless, knitted, flame-resistant liner;

placing a moisture barrier layer over the first web-adhesive;

placing a second web-adhesive over the moisture barrier layer;

placing a shell over the second web-adhesive;

melting the first and second web-adhesives, thereby adhering the liner to the moisture barrier layer and the moisture barrier layer to the shell;

affixing an upper edge of a cuff to the shell of the glove around its periphery, the cuff further comprising an outer surface and a lower edge; and affixing a resilient cuff grab bar to the cuff, the resilient cuff grab bar having a top portion, a bottom portion, a first side portion, a second side portion, and a middle portion between the top portion and the bottom portion, wherein the resilient cuff grab bar comprises:

a resilient member; and a flexible strip of material which surrounds the resilient member;

wherein the resilient cuff grab bar is affixed to the outer surface of the cuff of the glove along the first side portion, the second side portion, the middle portion and the bottom portion to enclose the resilient member between the middle portion and the top portion and in combination with the cuff form a closed off pocket between the resilient cuff grab bar and the cuff, and wherein the top portion of the cuff grab bar is adjacent to the upper edge of the cuff and the bottom portion of the cuff grab bar is adjacent to the lower edge of the cuff.

21. The method of claim 20, wherein the liner comprises a cut-resistant yarn.

22. The method of claim 20, wherein the liner has a terry looped surface.

23. The method of claim 20, wherein the moisture barrier layer is chosen from a breathable expanded polytetrafluoroethylene membrane or a polyurethane membrane.

24. The method of claim 20, wherein the flame-resistant shell comprises a natural or synthetic leather or textile.

25. The method of claim 20, wherein the liner comprises para-aramid, meta-aramid, modacrylic, flame-resistant treated cotton, a steel-fiberglass core composite yarn, or combinations thereof.

26. The method of claim 20, wherein the method further comprises disposing an insulation layer between the moisture barrier layer and the shell.

27. The method of claim 20, wherein the glove is compliant and/or certified to NFPA 1971, NFPA 1951, NFPA 1999, NFPA 2012, or military requirements.

28. The method of claim 20, wherein the first and second web-adhesives are flame resistant.

* * * * *